US009994435B2

(12) United States Patent
Hasler

(10) Patent No.: US 9,994,435 B2
(45) Date of Patent: Jun. 12, 2018

(54) FORKLIFT ARRANGEMENT

(71) Applicant: ABT PRODUCTS LIMITED, Hereford and Worcester (GB)

(72) Inventor: Michael Hasler, Hereford and Worcester (GB)

(73) Assignee: ABT Products Limited (GB)

( * ) Notice: Subject to any disclaimer, the term of this patent is extended or adjusted under 35 U.S.C. 154(b) by 0 days. days.

(21) Appl. No.: 15/312,719

(22) PCT Filed: May 13, 2015

(86) PCT No.: PCT/GB2015/051414
§ 371 (c)(1),
(2) Date: Nov. 21, 2016

(87) PCT Pub. No.: WO2015/177515
PCT Pub. Date: Nov. 26, 2015

(65) Prior Publication Data

US 2017/0183208 A1 Jun. 29, 2017

(30) Foreign Application Priority Data

May 23, 2014 (GB) ..... 1409175.5

(51) Int. Cl.
*B66F 9/06* (2006.01)
*B66F 9/10* (2006.01)
*B66F 9/12* (2006.01)

(52) U.S. Cl.
CPC ..... *B66F 9/10* (2013.01); *B66F 9/122* (2013.01)

(58) Field of Classification Search
CPC ..... B66F 9/06; B66F 9/122
USPC ..... 414/668, 686, 691, 715, 716, 917
See application file for complete search history.

(56) References Cited

U.S. PATENT DOCUMENTS 4,345,873 A * 8/1982 Wymore ..... B66F 9/065 212/304
5,150,999 A * 9/1992 Dugan ..... A01D 87/127 414/24.5
5,375,963 A * 12/1994 Wohlwend ..... B66C 23/48 212/203
5,577,878 A * 11/1996 Brown ..... B66F 9/0655 414/708
5,709,523 A * 1/1998 Ware ..... B66F 9/065 414/642

(Continued)

FOREIGN PATENT DOCUMENTS

DE 3723455 A1 1/1989
JP S4838682 Y1 11/1973

(Continued)

*Primary Examiner* — Douglas A Hess
(74) *Attorney, Agent, or Firm* — Skinner and Associates; Joel Skinner

(57) ABSTRACT

A forklift arrangement is described which comprises a mast (12), a carriage (18) movable along the mast (12), a first link (36) interconnecting the carriage (18) and a fork support member (24), a second link (38) interconnecting the carriage (18) and the fork support member (24) and extending substantially parallel to the first link (36) throughout the range of movement of the fork support member (24) relative to the mast (12), and a third, stabilizing link (44) interconnecting the first link (36) and a point fixed relative to the mast (12).

18 Claims, 4 Drawing Sheets

(56) References Cited

U.S. PATENT DOCUMENTS

| | | | | |
|---|---|---|---|---|
| 5,807,053 | A * | 9/1998 | Pride | A01D 87/127 414/24.5 |
| 7,704,035 | B2 * | 4/2010 | Borntrager | B62D 51/04 187/231 |
| 8,047,759 | B2 * | 11/2011 | Ladd | B66F 9/0655 414/685 |
| 8,186,931 | B2 * | 5/2012 | Borntrager | B62D 51/04 187/231 |
| 8,382,419 | B2 * | 2/2013 | Agoncillo | B66F 5/04 414/546 |
| 2012/0263565 | A1 * | 10/2012 | O'Keeffe | |

FOREIGN PATENT DOCUMENTS

| | | | |
|---|---|---|---|
| JP | H043800 | A | 1/1992 |
| JP | H07165398 | A | 6/1995 |

* cited by examiner

FORKLIFT ARRANGEMENT

This invention relates to a forklift arrangement, and in particular to a forklift arrangement whereby the forks of a forklift equipment device can be moved towards or away from a mast of the device to provide an extended level of reach.

Forklift trucks and other forklift equipment have been in use for many years in the handling of loads, for example loads carried upon pallets. The forklift equipment is advantageous in that it permits loads to be lifted from the ground or other surface and transported to another location. The load can be left positioned upon the ground, or may be positioned upon shelving or other supports. Furthermore, it may be positioned upon the load bed of a truck or other vehicle for transportation to a remote location.

Traditionally, forklift equipment was only capable of lifting loads substantially vertically relative to and adjacent the mast of the device. Whilst in many applications this limitation is acceptable, there are applications in which this limitation places severe constraints upon the manner in which the equipment can be used. By way of example, if loads are being positioned onto the load bed of a truck, or removed therefrom, in such a manner that the loads are arranged in two rows, one to the left hand side of the truck and one to the right hand side thereof, a traditional forklift device would need to be able to access both sides of the truck in order to be able to access all of the load. In some circumstances this is undesirable, and there has been a need for a forklift equipment device having an extended reach sufficient to allow the positioning and removal of such loads from just one side of the truck. Whilst described in relation to the loading and unloading of a truck, it will be appreciated that forklift equipment having an extended reach is suitable for use in a wide range of applications.

EP2477931 describes one form of forklift equipment having an extended reach. In the arrangement of EP2477931, a carriage is vertically movable relative to a mast. A first link connects the carriage to a set of forks. A second link interconnects the midpoint of the first link and a point fixed relative to the mast. A third link interconnects the second link and the set of forks. In use, when the carriage is spaced from the fixed point by a relatively great distance, the forks are held in a retracted position, close to the mast. Lowering of the carriage results in displacement of the forks away from the mast to an extended position, thereby allowing access to loads spaced from the mast.

One disadvantage of the arrangement of EP2477931 is that as the forks are moved between the extended and retracted positions, some tilting of the forks will occur. In order to compensate for this, the third link may take the form of a hydraulic cylinder and thus be of adjustable length. This results in the arrangement being of increased complexity, and may also reduce in the arrangement including additional weight in an area in which it is desired to minimise weight. Furthermore, in use, the operator may need to control the operation of the hydraulic cylinder in order to control the tilt of the forks. Operation may thus be of increased complexity.

It is an object of the invention to provide a forklift arrangement providing an extended reach and in which at least some of the disadvantages associated with known forklift reach systems are overcome or are of reduced effect.

According to the present invention there is provided a forklift arrangement comprising a mast, a carriage movable along the mast, a first link interconnecting the carriage and a fork support member, a second link interconnecting the carriage and the fork support member and extending substantially parallel to the first link throughout the range of movement of the fork support member relative to the mast, and a third, stabilising link interconnecting the first link and a point fixed relative to the mast.

In such an arrangement, movement of the carriage towards the fixed point results in movement of the fork support member away from the mast. During such movement, as the first and second links remain substantially parallel, in use, the fork support member will not tilt significantly relative to the mast. Accordingly, there is no need to provide an additional mechanism to control, reduce or avoid such tilting, and operation is simplified.

The first and second links are conveniently pivotally connected to the carriage about first and second pivot points, respectively, and pivotally connected to the fork support member about third and fourth pivot points, respectively, a notional straight line interconnecting the first and second pivot points extending parallel to a notional straight line interconnecting the third and fourth pivot points. Accordingly, it will be appreciated that the forklift equipment includes a parallelogram linkage arrangement.

The mast conveniently comprises two spaced uprights, the carriage including a first carriage part movable relative to one of the uprights and a second carriage part movable relative to the other of the uprights, the carriage parts being rigidly interconnected with one another. Preferably, the first link comprises a pair of link arms, each of which interconnects a respective one of the carriage parts and the fork support member. Similarly, the second link preferably comprises a pair of link arms, each of which interconnects a respective one of the carriage parts and the fork support member. Likewise, the third link preferably comprises a pair of link arms interconnecting the link arms of the first link and fixed points associated with respective ones of the uprights.

However, this need not always be the case. Depending upon the application in which the forklift equipment is to be used and the loads to which it is expected to be subject, the second link may comprise a single link arm. In normal use, the second link will be in tension, and so it is thought that the use of a single link arm will be adequate in many applications. Obviously, the use of single link arm in this regard allows weight savings to be made. It may also be possible to arrange for the third link to take the form of a single link arm. The third link is normally in compression, and so the use of a single link arm in this regard may not be suitable in some applications, and where used may require the link arm to be of relatively great dimensions in order to ensure that it can bear the compressive loads to which it will be subject.

Preferably, an actuator is provided to drive the carriage between raised and lowered positions, and hence drive the fork support member between retracted and extended positions. The actuator may comprise a hydraulic cylinder, for example connected to the carriage. It will be appreciated, however, that this need not always be the case and that it may be located elsewhere. Where the actuator is connected at one end to the carriage, the other end of the actuator may be connected to a point fixed relative to the mast. The force required to move the fork support member away from its fully retracted position is relatively high, and with an arrangement of the type outlined hereinbefore the actuator may need to be of a large size in order to be capable of applying the force required to operate the equipment during this phase of operation. Conveniently, therefore, rather than have the actuator connected to a point fixed relative to the mast, the actuator is connected to an extension of the third link.

The fork support member conveniently carries forks whereby a load can be lifted and maneuvered using the forklift equipment. The forklift equipment may include a tilt control arrangement whereby the tilt of the forks relative to the fork support member can be controlled. It may also or alternatively include a fork position adjustment mechanism to allow adjustment of the separation of the forks. Furthermore, a side shift arrangement may be provided to allow sideways movement of the forks relative to the fork support member.

The invention further relates to a forklift arrangement comprising an actuator operable to drive a carriage between raised and lowered positions relative to a mast, the carriage being connected to a fork support member by a linkage arrangement including a stabilising link and movable to drive the fork support member between retracted and extended positions, the stabilising link being pivotally connected to a fixed point relative to the mast, the actuator being connected to an extension of the stabilising link extending beyond the fixed point.

The invention will further be described, by way of example, with reference to the accompanying drawings, in which.

Figure 1:
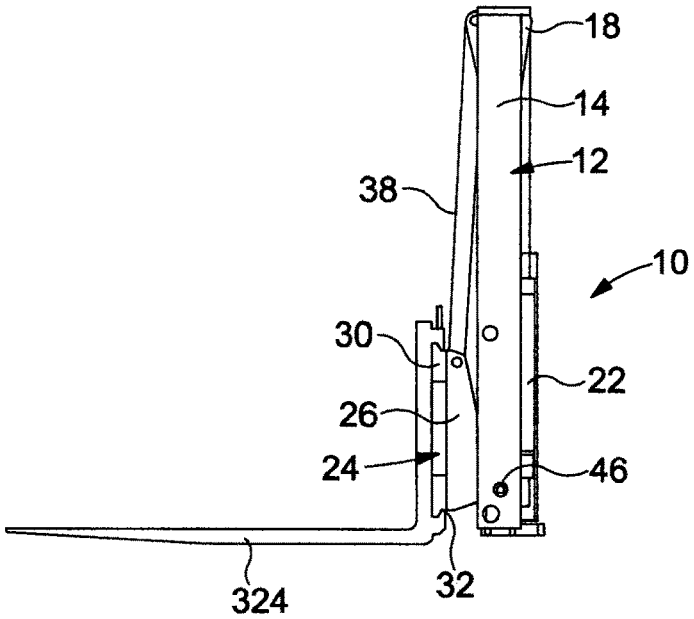
FIG. 1 is a diagrammatic side view of a forklift arrangement in accordance with one embodiment of the invention in a retracted position.

Referring firstly to FIGS. 1 to 4, a forklift arrangement 10 is illustrated, the arrangement 10 being intended for use as part of a forklift truck or other forklift equipment. The nature of the forklift truck or other forklift equipment is not of relevance to the invention and so will not be described herein in detail other than where required for an understanding of how the forklift arrangement 10 operates.

The forklift arrangement 10 comprises a mast 12 the form of a pair of uprights 14 arranged parallel to one another and secured to one another by upper and lower cross members 16. Each upright 14 is of channel shaped form. A carriage 18 is mounted upon the mast 12, the carriage 18 comprising a pair of side members 18*a*, 18*b* rigidly interconnected by a cross piece 18*c*. Each of the side members 18*a*, 18*b* has a pair of rollers 20 mounted thereon, the rollers 20 being received within the channels defined by the uprights 14 of the mast 12. Accordingly, it will be appreciated that the carriage 18 is mounted for movement along the length of the mast 12.

An actuator 22 in the form of a double acting hydraulic cylinder is mounted between the cross-piece 18*c* of the carriage 18 and the lower cross member 16, the actuator 22 being operable to drive the carriage 18 for movement relative to the mast 12. The cross piece 18*c* is conveniently located to the top of the carriage 18, maximising the stroke of the actuator 22 that can be used.

The forklift arrangement 10 further comprises a fork support member 24 comprising a pair of spaced mounts 26 to which a fork assembly 28 is secured. The fork assembly 28 includes upper and lower support rails 30, 32 carrying forks 34, the positions of the forks 34 on the rails 30, 32 being adjustable.

First and second links 36, 38 extend between the fork support member 24 and the carriage 18. The first link 36 comprises a pair of link arms 36*a*, 36*b*, each of which is pivotally connected at one end, to a respective one of the mounts 26 and pivotally connected at the other end to a respective one of the side members 18*a*, 18*b*. Likewise, the second link 38 comprises a pair of link arms 38*a*, 38*b* each of which is pivotally connected at one end to a respective one of the mounts 26 and pivotally connected at the other end to a respective one of the side members 18*a*, 18*b*. The link arms 36*a*, 36*b* are connected adjacent the lower edges of the mounts 26 and side members 18*a*, 18*b*, and the link arms 38*a*, 38*b* are connected adjacent the upper edges of the mounts 26 and side members 18*a*, 18*b*. The link arms 36*a*, 36*b* of the first link 36 are arranged substantially parallel to the link arms 38*a*, 38*b* of the second link 38.

The first and second links 36, 38 in combination with the mounts 26 of the fork support member 24 and the side members 18*a*, 18*b* of the carriage 18 together define a parallelogram shaped linkage arrangement. In such an arrangement it will be appreciated that a notional line 40 interconnecting the pivot points at which the links 36, 38 are connected to the carriage 18 will always remain parallel to a notional line 42 interconnecting the pivot points at which the links 36, 38 are connected to the fork support member 24. As the orientation of the line 40 is fixed relative to the mast 12, it will be appreciated that the line 42, and hence the orientation of the forks 34 will remain fixed relative to the mast 12, in use.

The arrangement further comprises a third, stabilising link 44 pivotally connected between a point 46 fixed relative to the mast 12 and a point 48 approximately midway along the length of the first link 36. The stabilising link 44 takes the form of a pair of stabilising link arms 44*a*, 44*b*, each of which is connected between a respective one of the link arms 36*a*, 36*b* and the respective upright 14.

Figure 2:
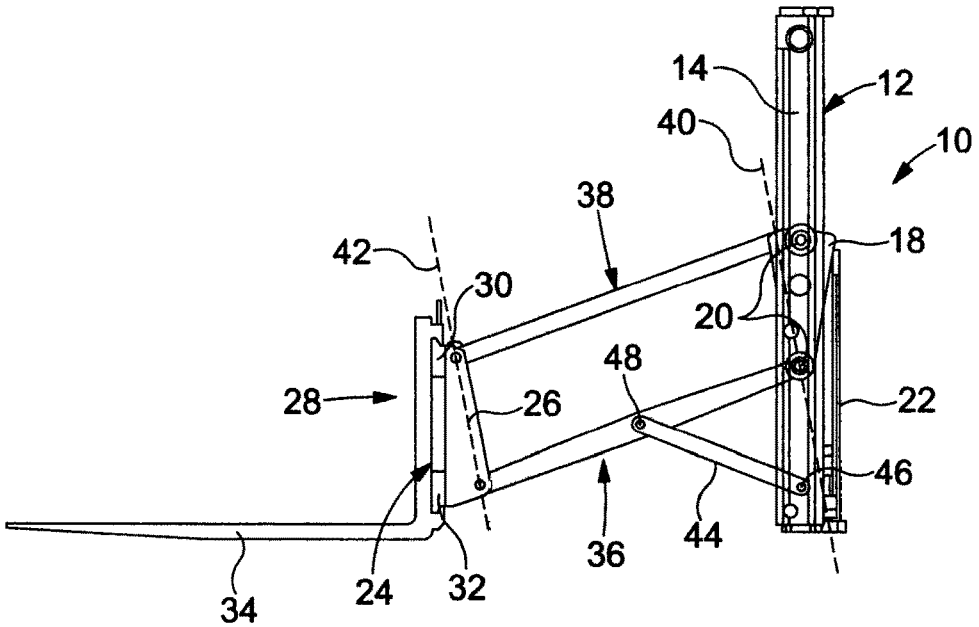
FIG. 2 is a view similar to FIG. 1 illustrating the arrangement in an extended position.
Figure 3:
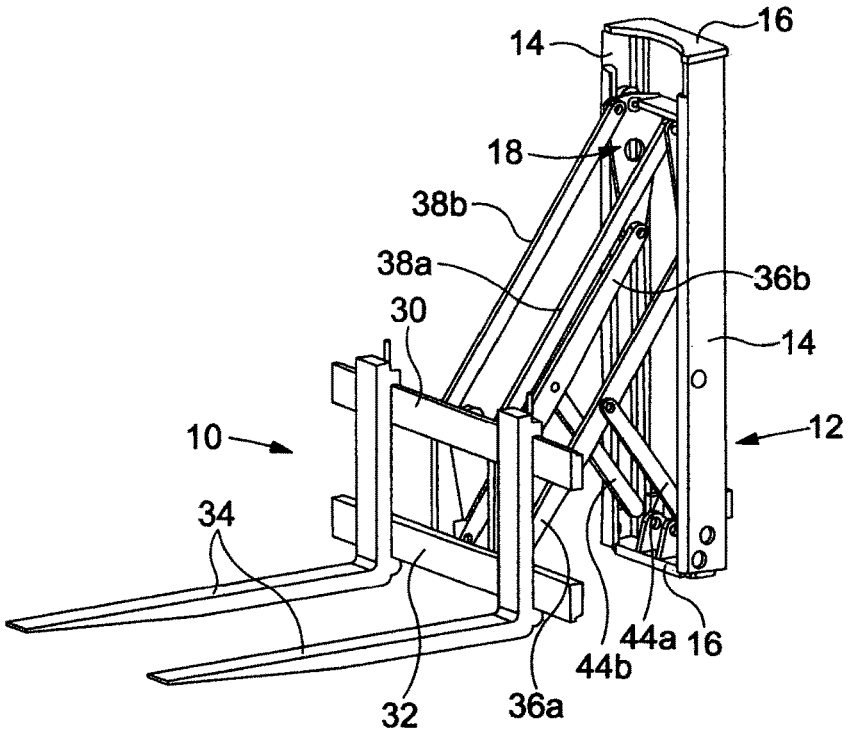
FIGS. 3 and 4 are further views illustrating the arrangement of FIGS. 1 and 2.
Figure 4:
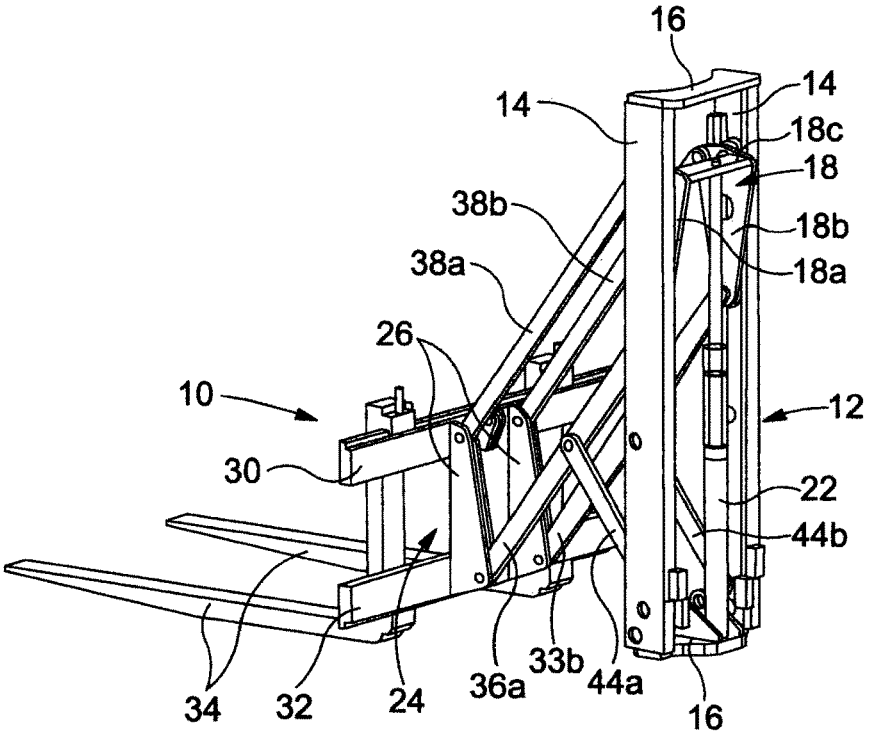

In use, the forklift arrangement is mounted upon a forklift truck or other forklift equipment in such a manner that the mast 12 is orientated substantially vertically, and may be raised or lowered under the control of an operator. With the forklift arrangement occupying its retracted position as shown in FIG. 1, should the operator require to drive the forks 34 away from the mast 12, for example to lift a load from a remote location or to position a load at that location, the actuator 22 is operated in such a manner as to reduce its length, driving the carriage 18 in the downward direction. As the carriage 18 moves downwards, the first link 36 and stabilising link 44 must both pivot about their respective pivot points to permit such movement, the pivoting movement resulting in the first link 36 and stabilising link 44 moving towards the position shown in FIG. 2. As the first and second links 36, 38 form part of a parallelogram shaped linkage and must remain parallel to one another, the second link 38 will also undergo pivotal movement during such movement of the carriage 18. It is clear that the downward movement of the carriage 18 and associated pivotal movement of the links 36, 38, 44 results in displacement of the fork support member 24 and forks 34 towards the extended position, as shown in FIG. 2. Movement of the forklift arrangement back towards its retracted position is achieved by driving the actuator 22 in the reverse direction extending the length thereof and so driving the carriage 18 back towards its starting position.

As the line 42 remains parallel to the line 40 regardless as to the position occupied by the forklift arrangement, it will be appreciated that no tilting movement of the forks 34 will occur during movement of the arrangement between its extended and retracted positions. Accordingly, there may be no need to provide a mechanism to control such tilting, and operation of the forklift arrangement is simplified as the operator does not need to make any adjustments to compensate for any such tilting. By avoiding the need to provide a tilt control mechanism, the need to provide relatively heavy components near the forks is avoided. This is advantageous as the load bearing capacity of a forklift truck or other equipment incorporating the arrangement may be increased without having to add ballast to the truck or other equipment.

The length of the stabilising link 44, that is to say the distance between the points 46, 48 at which it is pivotally connected to the first link 36 and to the mast 12, is preferably equal to or substantially equal to the distance between the point 48 at which the stabilising link 44 is connected to the first link 36 and the point at which the first link 36 is connected to the carriage 18. Preferably, the distance between the point 48 at which the stabilising link 44 is connected to the first link 26 and the point at which the first link 36 is connected to the fork support member 24 is also equal to the length of the stabilising link 44. Furthermore, the point 46 and the paths followed by the axes of the rollers 20 lie upon a common axis. Such a geometry is advantageous in that during movement of the forklift arrangement 10 between its extended and retracted positions, the fork support member 24 will not move in the vertical direction relative to the mast 12. As a result, control over the operation of the forklift arrangement 10 is relatively simple, there being no need for an operator to compensate for changes in height of the forks 34 by raising or lowering the mast 12 as the forklift arrangement is moved between its extended and retracted positions.

Figure 5:
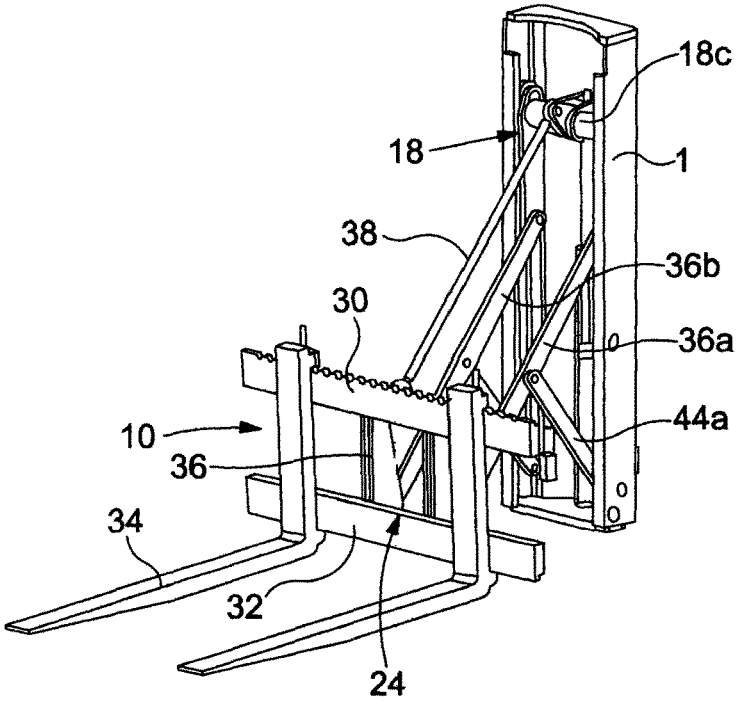
FIGS. 5 and 6 are views illustrating some modifications to the arrangement of FIGS. 1 to 4.

Whilst in the arrangement described hereinbefore, the second link 38 takes the form of a pair of spaced link arms 38*a*, 38*b*, this need not always be the case. FIG. 5 illustrates an embodiment in which a single, central link arm 38*c* is provided, the link arm 38*c* interconnecting the cross piece 18*c* of the carriage 18 and a central part of the fork support member 24. In use, the second link 38 will always be in tension, both when the forklift equipment is carrying a load and at other times. Accordingly, the link arm 38*c* forming the second link 38 may be of relatively slender and low weight form. Clearly the reduction in weight is advantageous. Furthermore, by using a single link arm in this location, an operator may have a less obstructed view of the load and the location in which the load is to be positioned or from which it is to be moved. As a result, use of the equipment may be simplified.

Figure 6:
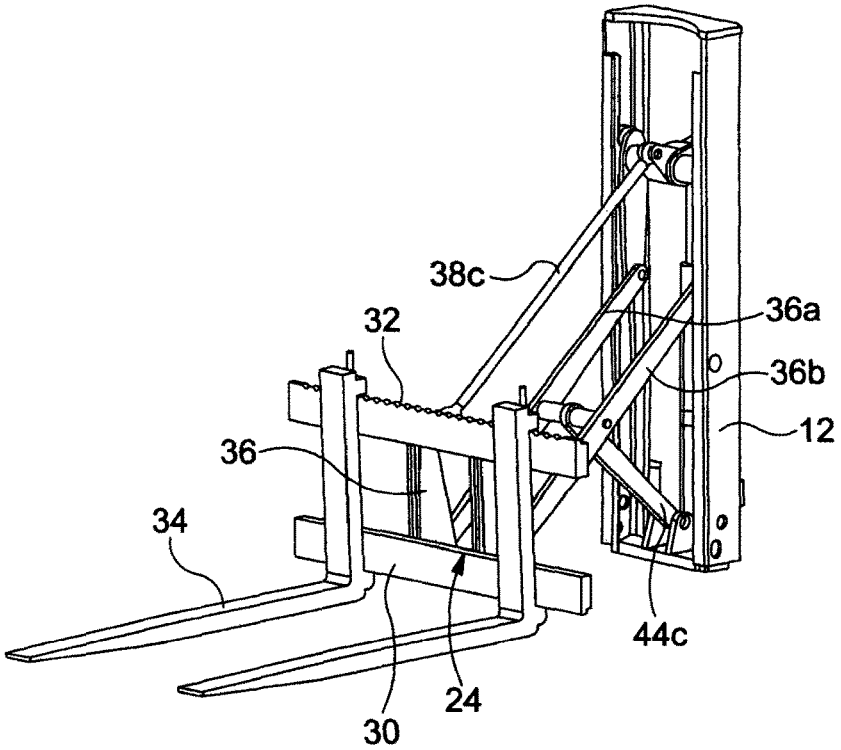

FIG. 6 illustrates a further modification in which the stabilising link 44 takes the form of a single, centrally located arm 44*c* instead of a pair of arms. As the stabilising link 44 is normally in compression, the use of a single arm in this location may result in the arm having to be of increased size and weight in order to ensure that the required loads can be carried by the equipment. However, the use of a single arm may, again, have the benefit that the operator's view is less obstructed.

Whilst FIG. 6 illustrates the use of a single arm as the stabilising arm in combination with the use of a single arm as the second link, it will be appreciated that these modifications to the arrangement of FIG. 1 may be used independently of one another. Furthermore, in some circumstances it may be possible to provide a single arm forming the first link. Again, as the first link is normally in compression, a single arm serving the function of this link would normally need to be of relatively large dimensions and weight in order to be able to bear the loads applied thereto, in use.

Figure 7:
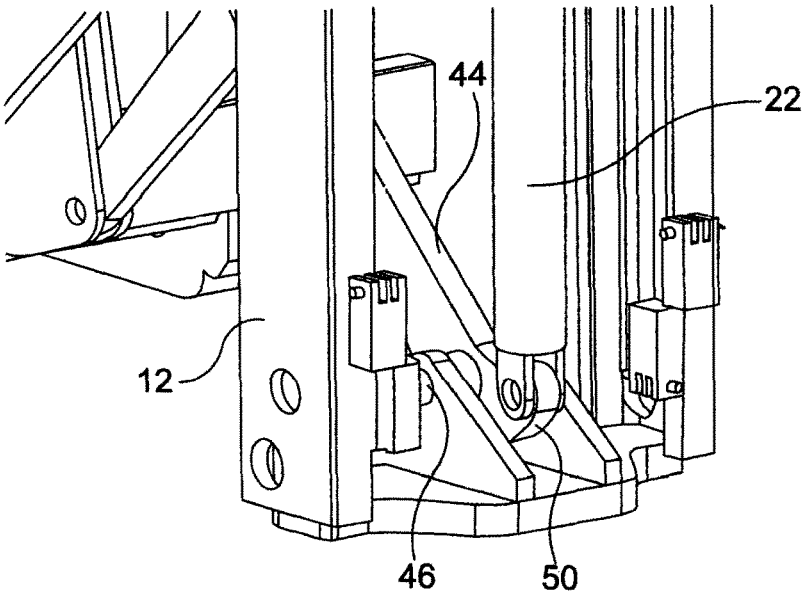
FIG. 7 is a view illustrating a further modification.

When the forklift arrangement 10 described hereinbefore is in its retracted position, the initial load that must be applied by the actuator 22 to commence movement of the carriage 18 is relatively high. Accordingly, the actuator 22 must be capable of applying such a load in order to drive the carriage 18, and hence the remainder of the arrangement, for movement. Likewise, the load required to return the arrangement to its fully retracted position is relatively high. FIG. 7 illustrates a modification which may be applied to any of the arrangements described hereinbefore and intended to assist in driving the arrangement from its retracted position and in returning the arrangement to its fully retracted position.

As shown in FIG. 7, the stabilising link 44 includes an integral extension 50 which extends beyond the point 46 at which the stabilising link 44 is pivotally connected to the mast 12. The arrangement shown in FIG. 7 is one in which a single link arm 44*c* forms the stabiliser link 44, but the modification is equally applicable to arrangements in which two link arms perform the function of the stabiliser link 44. The lower end of the actuator 22, rather than being connected to a fixed point on the mast 12, is connected to the extension 50. Accordingly, when forklift arrangement 10 is in its fully retracted position and the actuator 22 is operated to draw the carriage 18 in a downward direction to commence extension of the forklift arrangement 10, the extension 50 will simultaneously be drawn in an upward direction. The upward movement of the extension 50, by virtue of the pivotal mounting of the stabiliser link 44, causes pivoting movement of the stabilising link 44, assisting in driving the forklift arrangement away from the retracted position. The amount of assistance provided by the mounting of the actuator 22 to the stabilising link 44 will depend, in part, upon the length of the extension 50, the longer the extension 50 the greater the amount of assistance this modification achieves. However, increasing the length of the extension 50 reduces the compactness of the forklift arrangement, and so in selecting the length of the extension 50 there will be a trade-off between the benefit of assisting in driving the arrangement for movement and the compactness of the arrangement.

Whilst the provision of an extension 50 to the stabilising link 44, and the mounting of the actuator 22 to the extension 50 is described hereinbefore in relation to a forklift arrangement 10 of the type including a parallelogram shaped linkage, it will be appreciated that this modification is also applicable to other forms of reach system, and the invention is not restricted to the use of the extension in connection with a reach system including a parallelogram shaped linkage, but extends to its use with other reach systems, for example to the use of it with a system of the type described in EP2477931.

Figure 8:
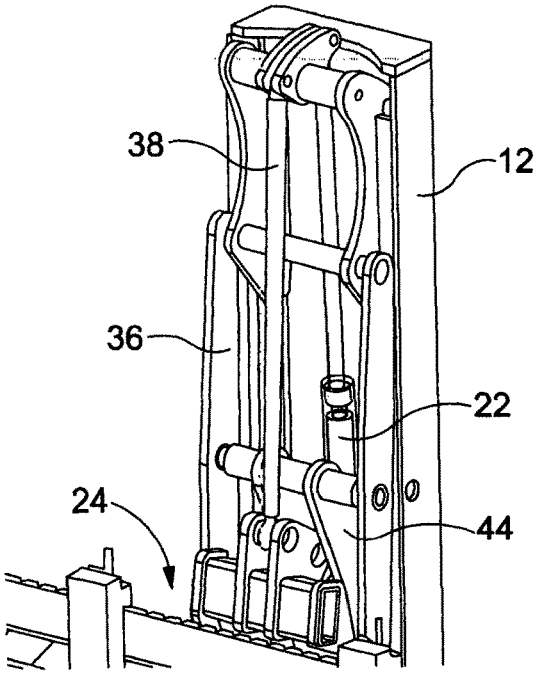
FIG. 8 is a view illustrating an alternative embodiment.

FIG. 8 illustrates a variation of the arrangement described and illustrated herein in which the shape of the carriage 18 is modified so that the first link 38 lies adjacent the front edge of the mast 12 when the arrangement occupies its retracted position. Such an arrangement may permit the forklift arrangement to be of improved compactness when retracted. In order to accommodate the fork support member 24 and various devices mounted thereon, the stabiliser link 44 in this arrangement is of curved form.

The forklift arrangements illustrated in the accompanying drawings are of a relatively simple form. It will be appreciated that, if desired, the forklift arrangement may incorporate a tilt control mechanism to permit the angle of the forks 34 to be adjusted relative to the fork support member 24. Likewise, if desired, a fork positioning arrangement may be incorporated to allow adjustment of the spacing of the forks. Furthermore, a side shift arrangement may be provided to permit the forks to be driven laterally relative to the fork support member 24, if desired.

It will be appreciated that a wide range of modifications and alterations may be made to the arrangement described hereinbefore without departing from the scope of the invention as defined by the appended claims.

The invention claimed is:

1. A forklift arrangement comprising a mast, a carriage movable along the mast, a first link interconnecting the carriage and a fork support member, a second link interconnecting the carriage and the fork support member and extending substantially parallel to the first link throughout the range of movement of the fork support member relative to the mast, and a third, stabilising link interconnecting the first link and a point fixed relative to the mast, the third, stabilising link being connected to the first link substantially midway along the length of the first link.

2. An arrangement according to claim 1, wherein the first and second links are pivotally connected to the carriage about first and second pivot points, respectively, and pivotally connected to the fork support member about third and fourth pivot points, respectively, a notional straight line interconnecting the first and second pivot points extending parallel to a notional straight line interconnecting the third and fourth pivot points.

3. An arrangement according to claim 1, wherein the mast comprises two spaced uprights, the carriage including a first carriage part movable relative to one of the uprights and a second carriage part movable relative to the other of the uprights, the carriage parts being rigidly interconnected to one another.

4. An arrangement according to claim 3, wherein the first link comprises a pair of link arms, each of which interconnects a respective one of the carriage parts and the fork support member.

5. An arrangement according to claim 3, wherein the second link comprises a pair of link arms, each of which interconnects a respective one of the carriage parts and the fork support member.

6. An arrangement according to claim 3, wherein the second link comprises a single link arm interconnecting the carriage and the fork support member.

7. An arrangement according to claim 3, wherein the third link comprises a pair of link arms interconnecting the first link and fixed points associated with respective ones of the uprights.

8. An arrangement according to claim 3, wherein the third link comprises a single link arm interconnecting the first link and a fixed point associated with the mast.

9. An arrangement according to claim 1, further comprising an actuator operable to drive the carriage between raised and lowered positions, and hence drive the fork support member between retracted and extended positions.

10. An arrangement according to claim 9, wherein the actuator comprises a hydraulic cylinder connected to the carriage.

11. An arrangement according to claim 10, wherein an opposite end of the actuator is connected to a fixed point relative to the mast.

12. An arrangement according to claim 10, wherein an opposite end of the actuator is connected to an extension of the third link.

13. An arrangement according to claim 1, wherein the fork support member carries forks whereby a load can be lifted and maneuvered using the forklift equipment.

14. An arrangement according to claim 13, further comprising a tilt control arrangement whereby the tilt of the forks relative to the fork support member can be controlled.

15. An arrangement according to claim 13, further comprising a fork position adjustment mechanism to allow adjustment of the separation of the forks.

16. An arrangement according to claim 13, further comprising a side shift arrangement to allow sideways movement of the forks relative to the fork support member.

17. A forklift arrangement comprising a mast, a carriage movable along the mast, a first link interconnecting the carriage and a fork support member a second link interconnecting the carriage and the fork support member and extending substantially parallel to the first link throughout the range of movement of the fork support member relative to the mast, and a third, stabilising link interconnecting the first link and a point fixed relative to the mast, the third, stabilising link being connected to the first link substantially midway along the length of the first link, wherein the mast comprises two spaced uprights, the carriage including a first carriage part movable relative to one of the uprights and a second carriage part movable relative to the other of the uprights, the carriage parts being rigidly interconnected to one another.

18. A forklift arrangement comprising a mast, a carriage movable along the mast, a first link interconnecting the carriage and a fork support member, a second link interconnecting the carriage and the fork support member and extending substantially parallel to the first link throughout the range of movement of the fork support member relative to the mast, and a third, stabilising link interconnecting the first link and a point fixed relative to the mast, the third, stabilising link being connected to the first link substantially midway along the length of the first link, further comprising an actuator operable to drive the carriage between raised and lowered positions, and hence drive the fork support member between retracted and extended positions, wherein the actuator comprises a hydraulic cylinder connected to the carriage, and wherein an opposite end of the actuator is connected to an extension of the third link.

* * * * *